United States Patent [19]

Westin

[11] 4,109,685

[45] Aug. 29, 1978

[54] HORIZONTAL HAND WEAVING LOOM

[76] Inventor: J. Ollie Westin, Sjovagen 7, S-183 52 Taby, Sweden

[21] Appl. No.: 636,838

[22] Filed: Dec. 2, 1975

[30] Foreign Application Priority Data

Dec. 4, 1974 [SE] Sweden ..... 7415035

[51] Int. Cl.[2] ..... D03D 29/00

[52] U.S. Cl. ..... 139/33

[58] Field of Search ..... 139/29-33

[56] References Cited

U.S. PATENT DOCUMENTS

| | | | |
|---|---|---|---|
| 1,020,292 | 3/1912 | Kinney | 139/33 |
| 1,181,728 | 5/1916 | Botts | 139/33 X |
| 2,193,558 | 3/1940 | Gallinger | 139/33 |
| 2,588,843 | 3/1952 | Iwald | 139/29 |
| 2,613,691 | 10/1952 | Ahrens | 139/33 |
| 2,783,777 | 3/1957 | Bologna et al. | 139/29 |
| 3,870,087 | 3/1975 | Henwood | 139/33 |

FOREIGN PATENT DOCUMENTS

| | | | |
|---|---|---|---|
| 602,927 | 1/1926 | France | 139/33 |
| 751,499 | 6/1933 | France | 139/33 |
| 325,266 | 3/1935 | Italy | 139/29 |
| 96,643 | 11/1922 | Switzerland | 139/33 |

*Primary Examiner*—James Kee Chi

*Attorney, Agent, or Firm*—Gipple & Hale

[57] ABSTRACT

A horizontal hand loom supported on brackets, tables, or the like, comprising a basic frame provided with warp beam, cloth beam, support frame, and harnesses located on either side of the support frame, said harnesses upwardly being hingedly connected to a manually pivotable means mounted on the support frame, and downwardly connected to at least one vertically pivotable rocker arm attached to a horizontal shaft in the lower portion of the support frame. The harnesses have the shape of rectangular or quadratic frames which inside their upper and lower horizontal frame portions removably carry a rigid bar or wire on which are threaded the permanent eyelets of the heddle strings.

7 Claims, 4 Drawing Figures

HORIZONTAL HAND WEAVING LOOM

FIELD OF THE INVENTION

The present invention relates to a hand weaving loom intended for horizontal warp, the loom being especially suitable for use if weaving is to take place preferably for therapeutic purposes.

BACKGROUND OF THE INVENTION, AND PRIOR ART

Conventional looms are often so large and heavy that they are difficult to move in an erected condition. In spite of the loom being large and heavy, it has relatively poor stability and often does not remain still during weaving. Furthermore, one is reduced during weaving to a single sitting height, and there are legs on the loom or the table, if it is standing on one, which prevent a person in a wheel-chair, for example, from weaving. The beater of the loom, pivotable about a horizontal axis is at right-angles to the weft only in the vertical plane through said axis. Since the weaving result will be worse for an oblique angle, the warp must be often advanced, so that one can only weave short distances at a time. When the warp is to be advanced, the pawl locking the ratchet on the warp beam must first be opened, before the cloth beam can be turned, and thereby it easily occurs that the warp beam is turned too far, so that the weaver must go from his place and turn the warp beam back again.

Heddle strings are threaded on to loose shaft rods and have a propensity for sliding on them. The shaft rods are connected upwardly to bobbing pins and downwardly to treadles via tie-up cords or the like. The connection is difficult to make without the shafts becoming slanted which results in poor and uneven shed and furthermore comparatively little shed, i.e. considerably less than is allowed by the reed per se. The shafts also lack positive guidance in table looms also, and consequently the shafts often slant. Suspending the shafts in pairs via bobbing pins for weaving of three- or multi-shaft weave leads to the shed being poor, especially when an uneven number of shafts are treadled. The free suspension of the shafts and heddle strings, the drawing down of the shafts by applying force at only one point on them in combination with many heddle strings also results in that the shed will not be at a maximum. A relatively normal tie-up requires the weaver to make about forty knots.

BRIEF SUMMARY OF THE INVENTION

The object of the present invention is to provide a loom which is especially suitable for use by persons with different handicaps or persons needing to exercise certain muscles or the like.

According to the invention, a basic frame with warp beam and cloth beam carries a support frame and on either side of the latter a harness, said harness being upwardly hingedly suspended in a manually pivotable means, pivotably mounted on the support frame and downwardly hingedly connected to at least one vertically pivotable rocker mounted on a horizontal shaft.

In accordance with a further characterizing feature of the invention, the rocker arm is attached to a reciprocatably pivotable crank which co-acts with tension springs.

In accordance with yet another characterizing feature, the harnesses are in the form of rectangular or quadratic frames which, on the inside of their upper and lower horizontal frame members removably support a stiff rod and on these rods or wires the permanent end eyelets of the heddle strings are threaded.

Still further characterizing features and advantages of the inventions will now be described in conjunction with the following more detailed descriptions of the preferred embodiments.

DESCRIPTION OF THE PREFERRED EMBODIMENTS

Figure 1:
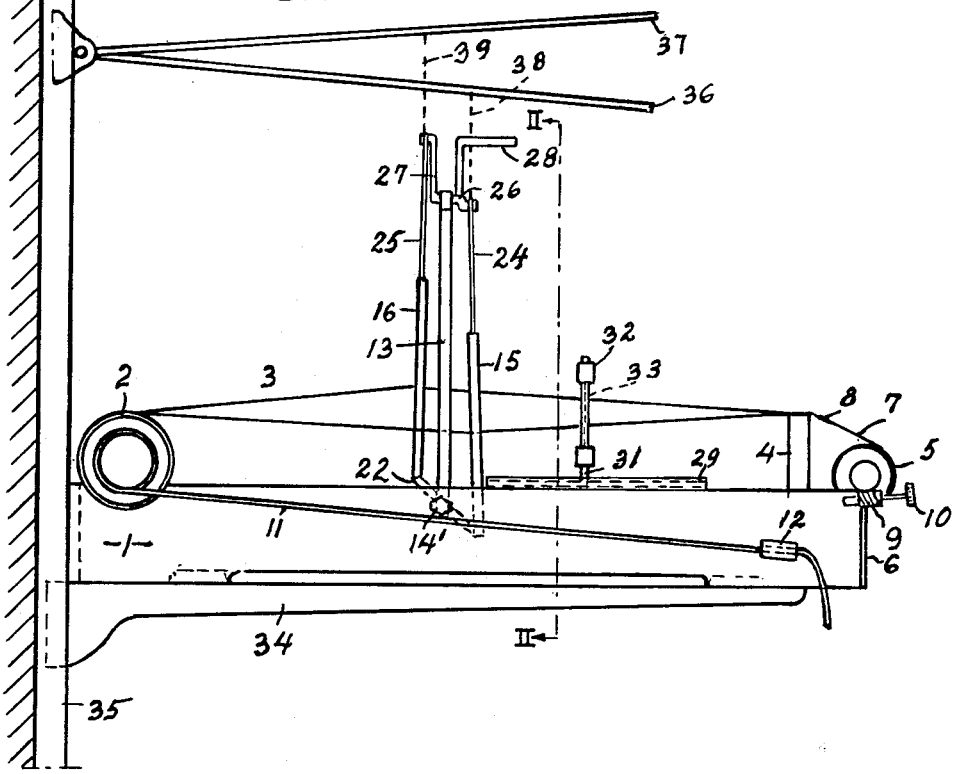
FIG. 1 is a side view of a loom according to the invention.
Figure 2:
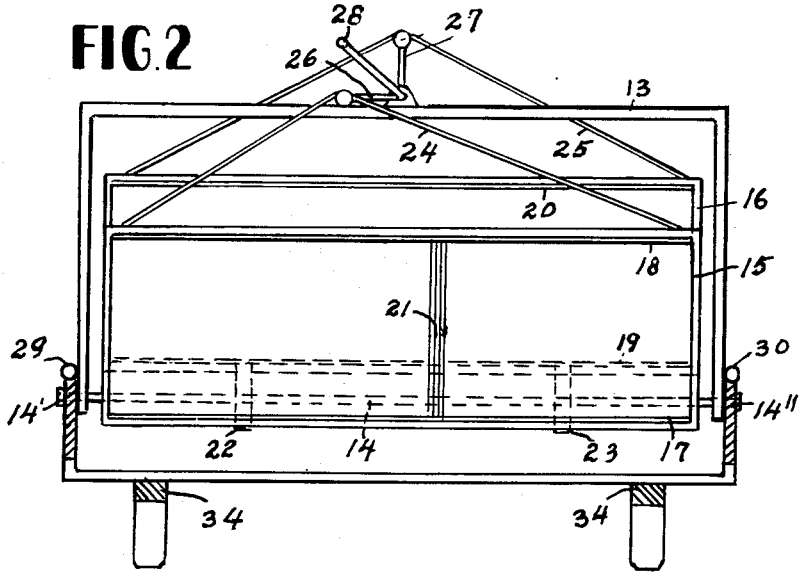
FIG. 2 is a loom seen in vertical section along the line II—II in FIG. 1.
Figure 3:
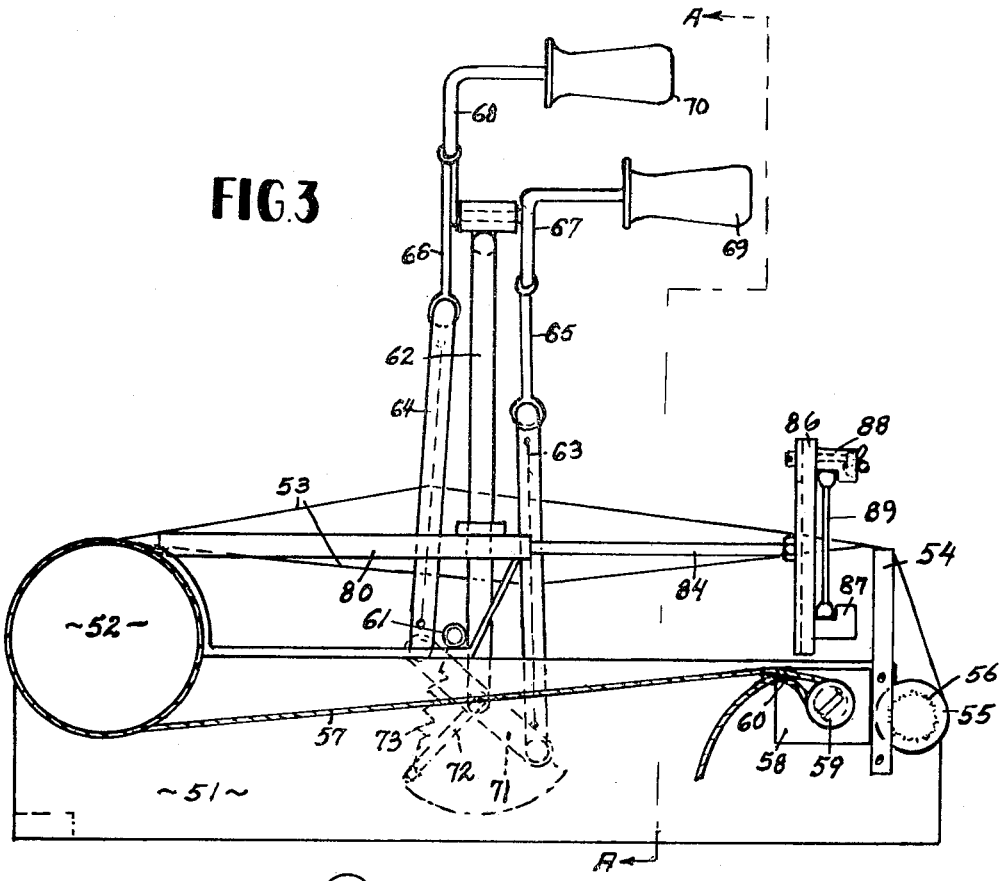
FIG. 3 is a side view of a modified loom according to the invention.
Figure 4:
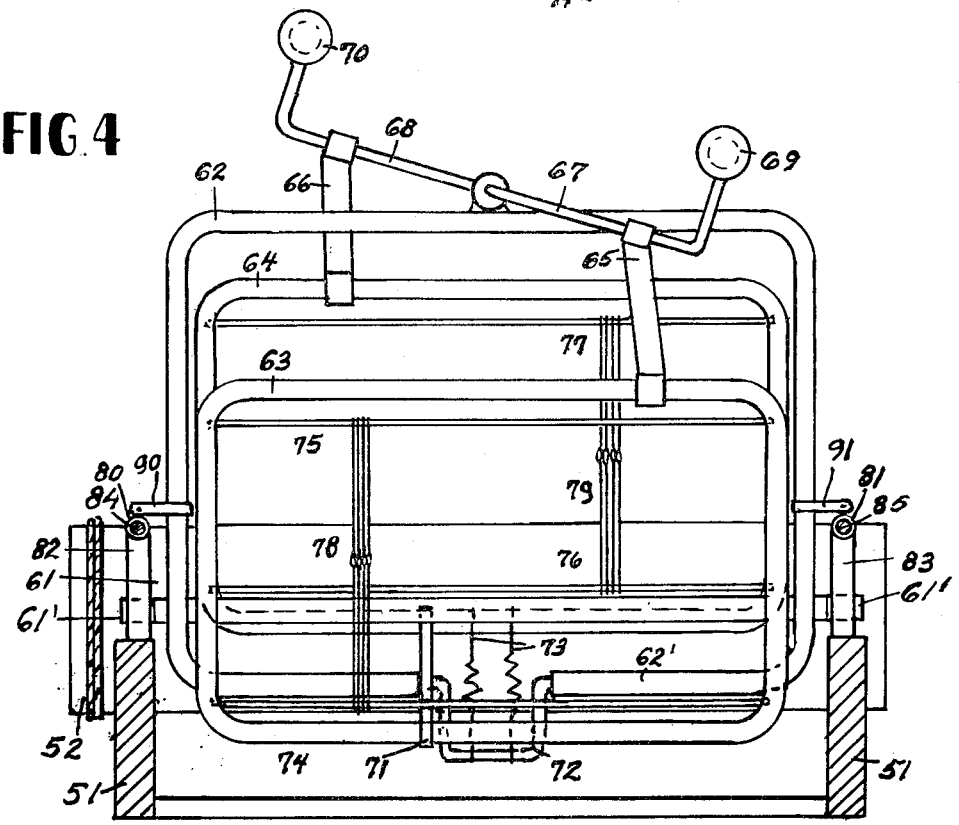
FIG. 4 is the loom in FIG. 3 seen in vertical section along the line A—A in FIG. 3.

According to the embodiment shown in FIGS. 1 and 2, the loom comprises a horizontal basic frame 1 on which there is mounted a warp beam 2 with warp threads 3 wound onto it, which go over a breast beam 4 to be connected to a cloth beam 5 which is removably mounted in fittings 6 on the basic frame 1. Both for the warp beam 2 and the cloth beam 5 there is suitably attached an apron 7 with an apron rod 8 to which the warp threads 3 are attached, the apron being visible on the drawing at the cloth beam 5. The cloth beam 5 is turned by means of a self-locking worm gear 9, provided with a wheel 10, and when the warp 3 is advanced, rotation of the warp beam 2 is braked by means of a rope or cord 11, which extends from the warp beam end to a schematically indicated rope clamp 12.

A vertical support frame 13 is united with the basic frame 1 by means of two bolts 14$^{I}$ and 14$^{II}$. Harnesses 15 and 16, respectively, are mounted on either side of the support frame 13. Each harness 15, 16 is formed from a rectangular (or quadratic) rigid frame preferably of wood, and at the upper and lower frame portions of the harnesses 15, 16 there is a stiff rod or wire such as piano wire, 17, 18 and 19, 20, removably attached to carry the heddle strings 21. Only a few heddle strings are shown threaded on the heddle bars 17–20 in FIG. 2, but in reality they completely fill or substantially fill the harnesses 15, 16. The latter are downwardly hingedly attached to two rockers 22, 23 fixed to a shaft 14 carried by the support frame 13. Upwardly the harnesses 15, 16 are each suspended by a suitable elastic band 24, 25 on treadle arms 26, 27 which are mounted on the support frame 13, and are pivotable by means of a hand treadle crank 28 for lowering and raising the harnesses 15, 16. The hand crank 28 can be exchanged for a wheel for training hand and arm gripping and twisting movements.

The hand treadle crank 28 can also be operated via extending arms 36 and 37. As best seen in FIG. 1, two extending arms 36 abd 37 are pivotably mounted to a vertical wall surface by a bracket. Extending arm 36 is connected to treadle arm 26 by string 38. Likewise, extending arm 37 is connected to treadle arm 27 by string 39. Thus rotative movement of hand carnk 28 can be substituted for by vertical movement of extending arms 36 and 37. Depending upon the individual operator of the loom and the physical therapy sought to be effected by the operation of the loom, the hand crank or extending arms can be used to operate the apparatus.

The basic frame also carries a pair of guides 29, 30 suitably formed from tubes slit longitudinally in their upper portions, or sliding door fittings or the like, in each of the guides 29, 30 there being guidingly and displaceably arranged a carrying means 31, of which only one is visible in FIG. 1. These carrying means 31 carry a beater 32 with reed 33.

The basic frame is set up on a pair of horizontal brackets 34 which, by means of hooks or the like are rigidly but removably attached to the basic frame. The brackets 34 are each adjustable to a desired height at their wall-mounted rails 35, which for the sake of clarity are not shown in FIG. 2. By means of such mounting for the loom, it does not have to have a definite weight to stay still during weaving, even during weaving of listing (rag) rugs, but can be made as light as possible, the warp beam and cloth beam can be made of light plastic tube for example, and remaining parts from light timber as far as possible, so that the complete loom can be carried in one hand. The support frame 13 carried on the bolts $14^{I}$, $14^{II}$ and the parts connected with the former can thereby be folded down against the basic frame to lessen the space requirements of the loom when it is put away in store. Since the beater runs in guides, and as the harness details and harness movement are concentrated, the outside dimensions of the loom will be small. For a web width of 90 cm the total width of the loom only needs to be 110 - 120 cm, its depth or length 80 cm and height 50 cm. Thanks to the lightness and small size of the loom, it can be moved from room to room even with a web in progress on it.

The described loom can, by means of adjusting the height of the brackets, be set at a suitable sitting height for the weaver. Even persons confined to wheel-chairs or whose bodily movement is restricted in some other way can easily get to and from the loom, and can also reach the operating means required for weaving even from a wheel-chair, The shallow depth of the loom makes for good accessability and makes it possible for one person to thread the heddle strings alone, whereon the harnesses can be slanted to obtain a good view. Since the beater 32 slides in the guides 29, 30 the angle to the weft, i.e. the angle between the plane of the reed 33 and the plane of the web will always be right-angular. Advancing the warp therefore does not have to be done as often as in a conventional loom. In the loom according to the invention it is possible to weave as much as the space between the breast beam and the harness permits, i.e. a relatively long length of web at a time. Regulation of the warp beam is done comfortably by means of the rope 11 without the weaver having to move, and there is no risk that the warp beam will be turned too far, since one has full control over the warp beam with the help of the rope. The cloth beam is handily rotatable by means of the hand wheel 10 via the worm gear 9 and is automatically locked thereafter by the worm gear. As the harnesses are rigid, permanent, wooden frames, arranging threading of the heddle strings has been enabled in a much more programmed way than with conventional looms. Since the harnesses are guided, the harness movement gives good and maximum shed. The heddles can be easily changed, supplemented etc on the heddle bars 17–20.

FIGS. 5 and 6 show a modified embodiment of the loom. On a basic frame 51 there is mounted a warp beam 52 with warp threads 53 wound on it, the threads passing over a breast beam 54 to a cloth beam 55, mounted in the basic frame 51 and manually rotatable by there being a ratchet wheel 56 at one end surface thereof, the ratchet having an operating handle and pawl not shown. Rotation of the warp beam 52 is braked by means of a rope or the like 57, turned round the warp beam and extending to a rope clamp 58 with a rope wheel 59, so that the length of rope from the warp beam to the rope clamp clamps fast the portion of the rope emerging the rope clamp against a supporting surface 60 in the rope clamp.

A tubular carrying shaft 61 across the basic frame is mounted in two bearings 61'. A vertical support frame 62 is attached to this carrying shaft 61, the support frame 62 projecting above the basic frame and being formed from a tube which is bent to form a generally rectangular frame.

On either side of the support frame 62 there is a vertical harness 63, 64, respectively. The upper portions of the harnesses 63, 64 are each suspended by a link e.g. a leather belt 65, 66, in a manually pivotable operating arm 67, 68 mounted in the uppermost portion of the support frame 62 and having handles 69, 70. The lower portion of the harness 63, 64 is hingedly connected to a rocker arm 71, which is fastened to the shaft of a crank 72, the shaft being pivotably mounted in the lower horizontal tube portion 62' of the support frame 62. Between the crank 72 and the carrying shaft 61 there extend two tension springs 73. The crank 72 is pivotable a short distance on either side of the vertical plane through the support frame, the tension springs 73 serving partly to co-act during the latter portion of the movement of the harnesses to their end positions, and partly to keep the harnesses in their respective end positions.

Each of the harnesses 63, 64 is formed from a tube bent into a rectangular frame, and carries parallel with the upper and lower frame portions rigid carrying rods or wires 74, 75 and 76, 77 respectively, on which the eyelets of the heddle strings 78, 79 are threaded. Only a few heddle strings are shown for each harness, but in reality they almost completely fill or to a substantial amount fill the harnesses 63, 64. The heddle bars 74–77 can be supported at one or several places along their lengths by there being removable hooks attached between the heddle bar and an adjacent portion of the harness frame. The removably inserted heddle bars 74–77 enable the heddle strings to be easily exchanged or supplemented.

On either side of the support frame 62 and a short distance above the basic frame 51 there is a horizontal tubular guide 80, 81, rigidly carried between fittings 82 and 83, respectively, which are attached to the basic frame. A bar-like slide 84 and 85, respectively, is displaceably mounted in the respective guide and carries on its free end a free cross-piece 86, of which only one is visible on the drawing. The cross-pieces carry a beater, formed by a carrying rail 87 attached to the lower ends of the cross-pieces, and an upper clamping rail 88 removably connected to the cross-pieces. A vertical reed 89 is retained between these rails. The beater with the reed 89 is manually displaceable in a direction to and from the web during weaving, while the slides 84, 85, slide in and out of the guides 80, 81. On each guide 80, 81 adjacent the support frame 62, a fork 90, 91 is pivotably mounted, the fork being pivotable into engagement with the support frame to retain it in a vertical position, or pivotable out of engagement with the support frame to allow the support frame to swing downwardly towards the basic frame when the loom is to be put away or transported.

The invention is not to be regarded as limited only to the described embodiments shown on the drawings, since the former can be modified within the scope of the invention.

I claim:

1. A horizontal hand weaving loom mountable on horizontal supports comprising a horizontal basic frame in which a warp beam and a cloth beam are rotatably mounted; a lineraly displaced beater with reed; a support frame projecting above the basic frame connected to the basic frame and carried by a horizontal shaft, said support frame being positioned between the warp beam and the cloth beam; a manually operable means mounted on the support frame which is connected by a link means to each one of at least two harnesses, said harnesses being positioned adjacent the support frame, said operable means adapted for raising and lowering the harnesses, the bottom portions of said harnesses being directly connected by hinge means to a rocker arm, said rocker arm being pivotably mounted about said horizontal carrying shaft in the support frame and connected to said at least two harnesses to operate said harnesses, said harnesses hinging freely between said manually operable means and each said rocker arm.

2. A hand loom as claimed in claim 1 wherein said link means is an elastic band.

3. A hand loom as claimed in claim 1 wherein said link means is a leather belt.

4. A hand weaving loom as claimed in claim 1, wherein said basic frame carries a plurality of fixed tubular guides outside the support frame and traverse to the support frame, in each of which a bar is guided for longitudinal displacement with a part of said bar being outside said guide carrying said beater.

5. A horizontal hand weaving loom mountable on horizontal supports comprising a horizontal basic frame in which a warp beam and a cloth beam are rotatably mounted; a linearly displaceable beater with reed; a support frame projecting above and connected to the basic frame and located at a place between the warp beam and the cloth beam; a manually operable means mounted on the support frame which is connected to at least two harnesses, said harnesses being in the form of a one piece rectangular frame which on the inside of their respective upper and lower frame portions carry a removable rigid member located in the frame on which a plurality of permanent end eyes of heddle strings are mounted and threaded said harnesses being moveably connected on their lower frame portions to a rocker arm which is pivotably connected to said basic frame.

6. A horizontal hand weaving loom mountable on horizontal supports comprising a horizontal basic frame in which a warp beam and a cloth beam are rotatably mounted; a lineraly displaceable beater with reed mounted to said basic frame; a support frame projecting above the basic frame and connected by a horizontal shaft to the basic frame located at a position between the warp beam and the cloth beam; a manually operable means mounted on the upper part of the support frame and connected with the upper part of each of at least two harnesses; a horizontal pivotal shaft with a crank journalled on the lower part of the support frame; said at least two harnesses being directly connected by hinge means to a rocker arm fixed on said pivotal shaft with the crank; and at least one tension spring applied between the crank and said horizontal shaft carrying said support frame.

7. A hand weaving loom as claimed in claim 6 wherein said manually operable means consists of two operating arms journalled on the uppermost portion of the support frame and each provided with a handle; each said arm connected by an elastic link to a harness.

* * * * *